United States Patent [19]

Sartor

[11] Patent Number: 4,982,515

[45] Date of Patent: Jan. 8, 1991

[54] SHELL STRUCTURE PARTICULARLY FOR SKI BOOTS

[75] Inventor: Mariano Sartor, Montebelluna, Italy

[73] Assignee: Nordica S.p.A., Montebelluna, Italy

[21] Appl. No.: 349,195

[22] Filed: May 8, 1989

[30] Foreign Application Priority Data

May 20, 1988 [IT] Italy ..... 82551 A/88

[51] Int. Cl.[5] ..... A43B 5/004; A43B 3/026

[52] U.S. Cl. ..... 36/117; 36/120; 36/97

[58] Field of Search ..... 36/117–121, 36/97

[56] References Cited

U.S. PATENT DOCUMENTS

| | | | |
|---|---|---|---|
| 3,609,887 | 10/1971 | Hickmann et al. | 36/121 X |
| 3,997,985 | 12/1976 | Shiina | 36/97 |
| 4,083,128 | 4/1978 | Rossman | 36/97 |
| 4,126,323 | 11/1978 | Scherz | 36/97 |
| 4,308,674 | 1/1982 | Tessaro | 36/118 |

FOREIGN PATENT DOCUMENTS

| | | | |
|---|---|---|---|
| 2446066 | 4/1976 | Fed. Rep. of Germany | 36/120 |
| 2358117 | 2/1978 | France | 36/117 |

*Primary Examiner*—Paul T. Sewell
*Assistant Examiner*—Ted Kavanaugh
*Attorney, Agent, or Firm*—Guido Modiano; Albert Josif

[57] ABSTRACT

Shell structure particularly usable to produce a ski boot, comprising at least two separate parts which can be selectively mutually joined and are composed of a first body which embraces the metatarsal region and the instep region and of a second body which embraces the region of the heel of the foot. The first and second bodies furthermore have, approximately at the ground resting region, guiding means constituted by complementary profiles defined on the two parts to stiffen the structure and telescopingly couple them.

8 Claims, 1 Drawing Sheet

SHELL STRUCTURE PARTICULARLY FOR SKI BOOTS

BACKGROUND OF THE INVENTION

The present invention relates to a shell structure particularly usable in ski boots.

Ski boots are currently usually composed of elements, such as the shell and the quarters, obtained by injection-molding thermoplastic material.

In particular, the manufacture of the shells requires the intervention of personnel after the molding has been performed in order to remove said shells from the mold.

Furthermore this operation must be immediate, since the shell has a structure which defines a narrowing at the foot instep, so that it is necessary to make use of the elastic deformation of said structure while it is still warm in order to remove it.

For this purpose machines are used having programmed motions, with the disadvantage of having to solve problems such as the centering of said machines with respect to the mold and the presetting of the machine's motions on three axes.

Due to the semi-closed configuration of the shell, it is furthermore necessary to use personnel to assemble its internal components, constituted by pressers, mechanical elements connectable to levers, and others.

Another disadvantage for the industrialization of ski boots resides in the fact that it is necessary to prepare a mold for each size in the range, increasing overall costs and entailing the selection of the size range to be offered to the public.

To this respect, the U.S. Pat No. 4,308,674 describes a monolithic front-entry ski boot composed of a shell, in which a soft inner shoe can be inserted, and of an element which is rearwardly associable with said shell and includes a quarter which embraces the rear part of the leg.

The sole of the shell is furthermore rearwardly provided with a pocket-shaped seat for coupling to said element, the locking therebetween occurring by means of downwardly arranged screws. The French Pat. No. 2,358,117 also describes a ski boot which allows the user to easily vary the size of the boot as the foot grows, this being a problem particularly felt in children's boots.

The main disadvantage observed in said known boots resides in the fact that the coupling provided by means of the pocket-shaped seat does not ensure an axially oscillation-free coupling between said element and said shell.

The element which can be rearwardly associated with the shell furthermore has a quarter which cannot be used for the entire range as it is a characterizing part of the boot.

Finally, the coupling region is furthermore visible, making the boot aesthetically unpleasant.

The fact is also stressed that the hypothetical size change can be achieved directly by the customer and cannot be univocally preset by the manufacturer.

SUMMARY OF THE INVENTION

The aim of the present invention is therefore to eliminate the disadvantages described above in known types by providing a shell which has optimum industrialization both during production and during assembly.

Within the scope of the above described aim, an important object is to provide a shell which allows to easily automate its production and/or assembly steps.

Another object is to provide a shell in which it is possible to achieve a considerable increase in production for an equal number of executable moldings.

Yet another object is to provide a shell in which the same components can be used during assembly to obtain different sizes which cannot be modified by the user.

Not least object is to provide a shell which is structurally simple, reduces industrialization costs and can be produced with conventional systems and known machines.

The above described aim and objects, as well as others which will become apparent hereinafter, are achieved by a shell structure, particularly for ski boots, comprising at least one first body adapted to embrace the metatarsal region and the foot instep and at least one second body adapted to embrace the heel of the foot, said first and second bodies having guiding means for their mutual telescoping coupling, characterized in that said first and second bodies are separately obtained by molding and are subsequently coupled by virtue of coupling means to provide said shell structure, various sizes of said shell being obtainable by means of said telescoping coupling, said first body and said second bodies being rigidly associated with one another during the use of said boot.

BRIEF DESCRIPTION OF THE DRAWINGS

Further characteristics and advantages of the invention will become apparent from the detailed description of a particular but not exclusive embodiment, illustrated only by way of non-limitative example in the accompanying drawings, wherein.

DESCRIPTION OF THE PREFERRED EMBODIMENTS

Figures 1, 2, 3, 4:
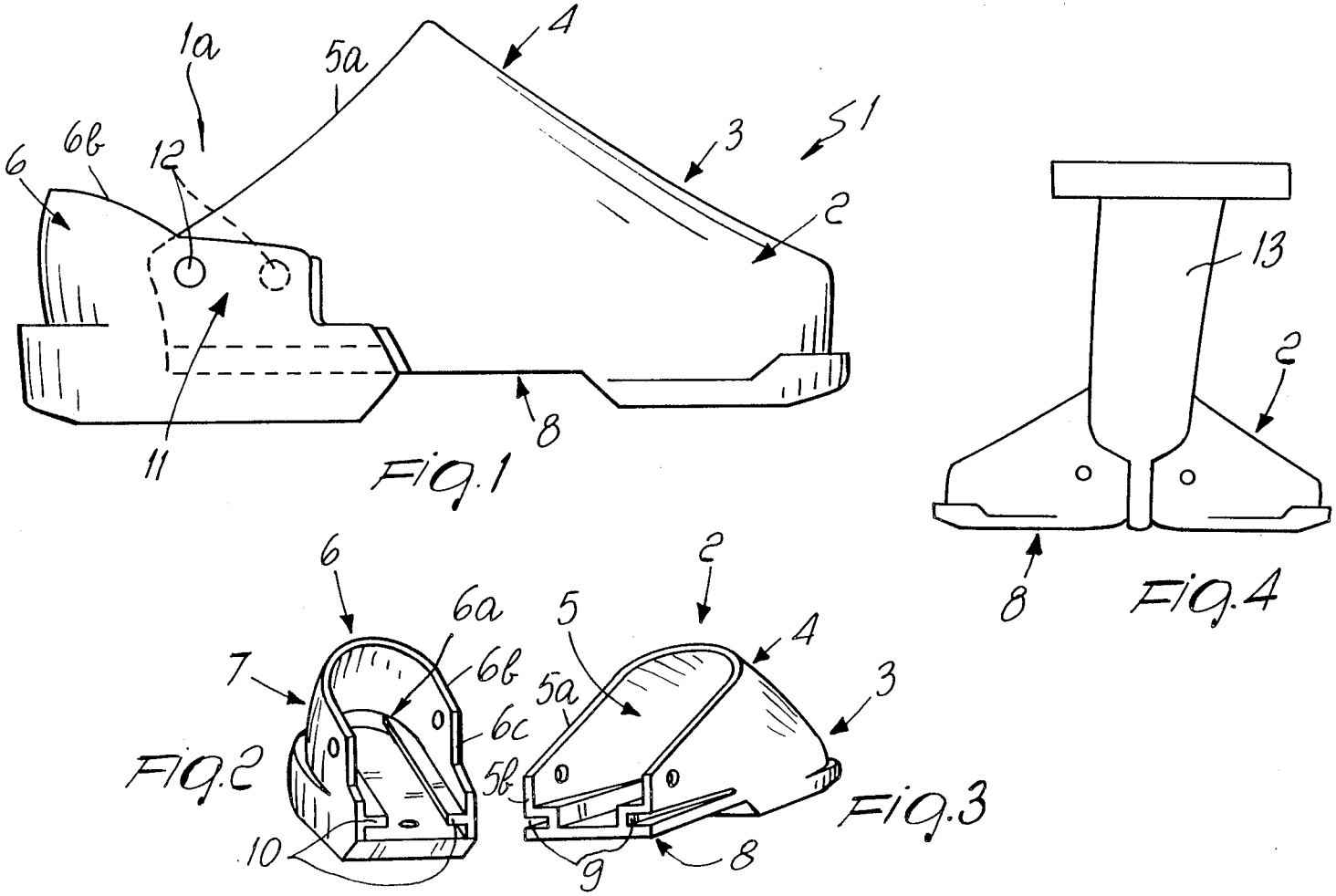
FIG. 1 is a side view of the structure.
FIG. 2 is a front isometric view of the second body.
FIG. 3 is a rear isometric view of the first body.
FIG. 4 is a view of the production of two units of the first body during a single molding process.

With reference to the above described figures, the reference numeral 1 indicates a shell particularly usable for a ski boot, which is constituted by two separate parts which can be selectively joined to one another laterally and/or downwardly. The shell portion 1 defines an upwardly facing aperture 1*a*.

Said shell 1 is therefore constituted by a first hollow body 2 affecting the metatarsal region 3 and the instep region 4.

Said first body 2 furthermore has a rearward opening 5 for inserting the soft inner shoe and other components, such as a presser, cables and others, in said first body. As can been seen from FIG. 3, the rearward opening 5 is perimetrally defined by an upper border 5*a* and a lower border 5 *b* of the first body 2.

Said opening 5 therefore facilitates and possibly automates the assembly of said components, since a possible operating head can operate on a horizontal plane by virtue of the direct access to the inside of the first body 2.

A second body 6 furthermore co-operates to define the shell 1 and embraces the heel region 7.

The second body 6 is also hollow and has a forward aperture 6*a* to accommodate the heel region of the inner shoe which can be inserted at the opening 5 inside the first body 2. As can be seen from FIG. 2, the forward opening 6a is perimetrally defined by an upper edge 6b and a lower edge 6c of the second body 6.

At its rear end, proximate to its lower surface 8, said first body 2 has a pair of longitudinal lateral grooves 9 for guiding complementarily shaped raised or tongue portions 10 which protrude inwardly from the lateral surfaces of said second body 6.

Said grooves 9 and said raised or portions 10 have the function of stiffening the structure, avoiding relative oscillatory motions of the two parts, and of facilitating the coupling between said first body 2 and said second body 6, ensuring their mutual centering; in this manner the lateral surfaces of the second body 6 embrace the corresponding ones of the first body 2, which thus arranges itself inside said second body 6.

Said two bodies couple at the malleolar region 11 by virtue of high-frequency welding processes and/or mechanical coupling and complementary coupling means such as for example rivets 12 or screws and/or glueing.

A mechanical coupling may also be advantageously provided at the lower surface of the shell 1.

The position of the possible rivets 12 may advantageously coincide with the articulation points of a possible quarter associable with the shell 1 thus obtained.

The shell structure thus obtainable therefore has the advantage of allowing to separately manufacture the first body 2 and the second body 6, said bodies being very easy to remove from their molds even by virtue of preset mechanisms adapted to merely slip them off and not to twist them off, such as for example simple extractors.

As illustrated in FIG. 4, it is furthermore possible to simultaneously mold two units of said body 2 using a T-shaped mold 13; an even higher productivity can be achieved with the body 6 due to the part's simplicity.

This therefore allows a considerable increase in production for an equal number of executable moldings.

The presence of the opening 5 at the second body 6 furthermore allows to facilitate and possibly automate the assembly of the internal components of the shell 1, since the head of the machine may work on a horizontal plane by virtue of said opening.

As regards the adaptation of the shell to various sizes, it is sufficient to provide, during assembly, a different position for the connection of said first body 2 with said second body 6 before said bodies are coupled to one another.

This allows, for example, to produce four elements of different dimensions constituting the first body 2 and two elements, also of different sizes, constituting said second body 6, to cover the range of eight sizes, thus considerably reducing the number of molds with considerable advantages in economy, management, production and organization.

The lateral coupling proximate to the malleolar region between said first body 2 and said second body 6 achieves an aesthetic advantage since the coupling region is concealed by the quarter's lower edge.

The fact is furthermore stressed that the second body 6 can be used for all the models in the range, further reducing the number of molds.

The lateral coupling between the components of the shell 1 furthermore allows to pivot the quarters at said fixing points, so that for example in a rear-entry boot the front quarter may be pivoted to the front fixing point and the rear quarter may be pivoted to a point adjacent to the preceding one. In this manner the quarters follow the size variations of the shell, without varying the gap between the surfaces for the coupling of said shell and said quarter.

It has thus been observed that the invention achieves the intended aim and objects, a shell having been provided which has optimum industrialization both during production and during assembly.

The invention thus conceived is naturally susceptible to numerous modifications and variations, all of which are within the scope of the same inventive concept.

I claim:

1. Shell structure for ski boots, comprising at least one first body and at least one second body, a metatarsal region being defined by said at least one first body, a foot instep region being defined by said at least one first body, said at least one first body encompassing said metatarsal region and said foot instep region, a heel region being defined by said at least one second body, said at least one second body encompassing said heel region, wherein said shell structure further comprises guiding means and coupling means, said guiding means being associated with said at least one first body and with said at least one second body, a telescoping coupling of said at least one first body with said at least one second body being provided by said guiding means, said guiding means stiffening and mutually centering said at least one first body and at least one second body to thereby provide said shell structure, said coupling means being associated with said at least one first body and with said at least one second body, a rigid coupling of said at least one first body with said at least one second body being provided by said coupling means, said at least one first body and said at least one second body being individually manufactured by separate molding, said coupling means comprising a plurality of rivets, said plurality of rivets being constituted by a first pivoting element and a second pivoting element, said first pivoting element being associable with said at least one first body, said second pivoting element being associable with said at least one second body, whereby said first pivoting element and said second pivoting element act as pivot points for respective quarters of ski boot.

2. Structure according to claim 1, wherein said at least one first body is hollow, a rearward opening being defined by said at least one first hollow body, said rearward opening being adapted to allow for an insertion of a soft shoe.

3. Structure according to claim 1, wherein said at least one second body is hollow, a forward opening being defined by said at least one second hollow body, said forward opening being adapted to allow for an insertion of a soft shoe.

4. Structure according to claim 1, wherein said guiding means comprise a pair of lateral guiding grooves and a pair of protrusions, said pair of lateral guiding grooves being provided on said at least one first body at rearward end external lateral surfaces thereof, said pair of protrusions being provided on said at least one second body at forward end internal lateral surfaces thereof, said pair of protrusions being complimentarily shaped to said pair of lateral guiding grooves, said pair of protrusions of said at least one second body slidably engaging said pair of lateral guiding grooves of said at least one first body, a malleolar region being defined where said pair of protrusions a slidably engage said pair of lateral guiding grooves.

5. Structure according to claim 4, wherein said at least one first body is partially arranged inside said at least one second body at said malleolar region.

6. A composite adjustable ski boot shell structure having a longitudinal extent and an widthwise extent, comprising a separately moldable hollow forward body portion of the shell for receiving therein user's metatarsal and instep foot portions and a separately moldable hollow rearward body portion of the shell adjustably connectable to said forward body portion for receiving therein a user's heel portion of the foot, said separately moldable hollow forward body portion defining an inside thereof and having a forwardly facing extent and a rearwardly facing extent, at least said rearwardly facing extent having guide means for telescopingly adjustable positioning relative to said rearward body portion and defining a rearwardly facing opening for a direct access into said inside thereof of operating head means, insertion of boot components and easy removal from molds by slipping off action, said rearwardly facing extent having coupling means for connecting together said forward and said rearward body portions, said separately moldable hollow rearward body portion defining an interior thereof and having a forwardly facing aperture for a direct access into said interior thereof of operating head means, insertion of boot components and easy removal from molds by slipping off action, and having further complementary guide means for cooperation with said guide means and for telescopingly adjustable positioning relative to said forward body portion and complementary coupling means cooperating with said coupling means for connecting together said forward and said rearward body portions, said guide means and said complementary guide means extending parallel to said longitudinal extent and including cooperating groove and tongue formations for stiffening and mutually centering said forward body portion and said rearward body portion, said rearwardly facing opening and said forwardly facing aperture having differentiated widthwise extends for allowing mutual partial insertion thereof into one another, said coupling means and said complementary coupling means including rivet means defining rivet axes, said shell structure including articulation means for articulated quarter elements thereof having an articulation axis coinciding with one of said rivet axes.

7. A composite adjustable ski boot shell structure including articulation means for articulated quarter elements thereof, said articulation means defining each an articulation axis, the structure having a longitudinal extent and a widthwise extent, the structure comprising a separately moldable hollow forward body portion of the shell for receiving therein user's metatarsal and instep foot portions and a separately moldable hollow rearward body portion of the shell adjustably connectable to said forward body portion for receiving therein a user's heel portion of the foot, said separately moldable hollow forward body portion defining an inside thereof and having a forwardly facing extent and a rearwardly facing extent, at least said rearwardly facing extent having guide means for telescopingly adjustable positioning relative to said rearward body portion and defining a rearwardly facing opening for direct access into said inside thereof of operating head means, insertion of boot components and easy removal from molds by slipping off action, said rearwardly facing extent having coupling means for connecting together said forward and said rearward body portions, at least one of said coupling means being in the form of rivet means having a rivet axis coinciding with said articulation axis, said separately moldable hollow rearward body portion defining an interior thereof and having a forwardly facing aperture for a direct access into said interior thereof of operating head means, insertion of boot components and easy removal from molds by slipping off action, and having further complementary guide means for cooperation with said guide means and for telescopingly adjustable positioning relative to said forward body portion and complementary coupling means cooperating with said connection means for connecting together said forward and said rearward body portions, at least one of said complementary coupling means being in the form of said rivet means having said rivet axis coinciding with said articulation axis, said guide means and said complementary guide means extending parallel to said longitudinal extent and including cooperating groove and tongue formations for stiffening and mutually centering said forward body portion and said rearward body portion, said rearwardly facing opening and said forwardly facing aperture having differentiated widthwise extends for allowing mutual partial insertion thereof into one another.

8. A composite adjustable shell structure for ski boots having a longitudinal extent, a widthwise extent, and an upwardly facing aperture for receiving therein user's foot, said shell structure comprising a separately moldable hollow forward body portion of the shell for receiving therein user's metatarsal and instep foot portions and a separately moldable hollow rearward body portion of the shell adjustably connectable to said forward body portion for receiving therein a user's heel portion of the foot.

said separately moldable hollow forward body portion defining an inside thereof and having a forwardly facing extent and a rearwardly facing extent, at least said rearwardly facing extent having guide means for telescopingly adjustable positioning relative to said rearward body portion and defining a rearwardly facing opening for a direct access into said inside thereof of operating head means, insertion of boot components and easy removal from molds by slipping off action, said rearwardly facing extent having coupling means for connecting together said forward and said rearward body portions, said rearwardly facing opening being defined by an upwardly arranged upper perimetral border of said forward body portion and a forwardly arranged lower perimetral border of said forward body portion, said separately moldable follow rearward body portion defining an interior thereof and having a forwardly facing aperture for a direct access into said interior thereof of operating head means, insertion of boot components and easy removal from molds by slipping off action, and having further complementary guide means for cooperation with said guide means and for telescopingly adjustable positioning relative to said forward body portion and complementary coupling means cooperating with said coupling means for connecting together said forward and said rearward body portions, said forwardly facing aperture being defined by an upwardly arranged upper perimetral edge of said rearward body portion and a forwardly arranged lower perimetral edge of said rearward body portion.

said guide means and said complementary guide means extending parallel to said longitudinal extent and including cooperating groove and tongue formations for stiffening and mutually centering said forward body portion and said rearward body portion, said rearwardly facing opening and said forwardly facing aperture having differentiated widthwise extends for allowing mutual partial insertion thereof into one another, said upwardly facing aperture of said shell structure being defined by at least a portion of said upwardly arranged upper perimentral border of said forward body portion and by at least a part of said upwardly arranged upper perimetral edge of said rearward body portion.

* * * * *